US005781835A

United States Patent [19]

Okano et al.

[11] Patent Number: 5,781,835

[45] Date of Patent: Jul. 14, 1998

[54] DEVELOPING DEVICE COMPRISING A MAGNETIC MEMBER

[75] Inventors: Keiji Okano, Tokyo; Takahiro Inoue, Yokohama; Masaki Ojima, Inagi; Seiji Yamaguchi, Tokyo, all of Japan

[73] Assignee: Canon Kabushiki Kaisha, Tokyo, Japan

[21] Appl. No.: 556,697

[22] Filed: Nov. 13, 1995

[30] Foreign Application Priority Data

Nov. 11, 1994 [JP] Japan ..... 6-301638

[51] Int. Cl.[6] ..... G03G 15/08; G03G 21/00

[52] U.S. Cl. ..... 399/275; 399/267

[58] Field of Search ..... 399/53, 55, 222, 399/267, 270, 274, 275, 277; 430/122

[56] References Cited

U.S. PATENT DOCUMENTS

| | | | |
|---|---|---|---|
| 4,341,179 | 7/1982 | Hosono et al. | 399/275 X |
| 4,637,706 | 1/1987 | Hosoi et al. | 399/275 |
| 4,766,468 | 8/1988 | Hosono et al. | 399/275 X |
| 4,876,574 | 10/1989 | Tajima et al. | 399/275 |
| 4,989,044 | 1/1991 | Nishimura et al. | 399/275 |
| 5,084,733 | 1/1992 | Katoh et al. | 399/104 |
| 5,177,537 | 1/1993 | Okano et al. | 399/222 |
| 5,185,496 | 2/1993 | Nishimura et al. | 399/275 |
| 5,353,104 | 10/1994 | Kato et al. | 399/274 |
| 5,547,724 | 8/1996 | Kuribayashi | 399/222 X |

FOREIGN PATENT DOCUMENTS 6-308817 11/1994 Japan .

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A developing device includes a developer container for accommodating one component magnetic toner; a rotatable toner carrying member, faced to an image bearing member for bearing an electrostatic image to form a developing zone therebetween, for carrying the toner in the container; a magnet member in the toner carrying member; a regulating member, elastically urged to the toner carrying member to form a nip therebetween, for regulating a toner layer thickness on the toner carrying member; wherein the magnet member has a magnetic pole, upstream of the nip with respect to a movement direction of the toner carrying member, for supplying the toner in the container to the toner carrying member, and wherein the magnet member does not generate a magnetic field effective for chain erection of the toner in a range from an upstream end of the nip to a downstream end of the developing zone.

10 Claims, 9 Drawing Sheets

| M/S* | 0.8 | 1 | 1.5 | 2 | 2.5 | 2.7 | 3 |
|---|---|---|---|---|---|---|---|
| FOG | G | G | G | G | F | NG | NG |
| SCATTER | G | G | G | G | F | NG | NG |
| DENSITY | NG | F | G | G | G | G | G |

$M/S^* = (M/S) \times (Vs/Vp)$

| M/S* | 0.5 | 0.6 | 1 | 1.5 | 1.7 | 2 |
|---|---|---|---|---|---|---|
| FOG | G | G | G | F | NG | NG |
| SCATTER | G | G | G | F | NG | NG |
| DENSITY | NG | F | G | G | G | G |

$M/S^* = (M/S) \times (Vs/Vp)$

DEVELOPING DEVICE COMPRISING A MAGNETIC MEMBER

FIELD OF THE INVENTION AND RELATED ART

The present invention relates to a developing apparatus usable with an image forming apparatus of electrophotographic type or electrostatic recording type.

Referring first to FIG. 14, there is shown a conventional image forming apparatus.

Designated by 101 is the main assembly of the image forming apparatus. A photosensitive drum 111 is a cylindrical electrostatic latent image bearing member which is unidirectionally rotatable about an axis. A surface of the photosensitive drum 111 is uniformly charged by the charging device 103, and thereafter, a latent image is formed thereon by exposure device 102. A developing device 104 is provided with a hopper 108 for keeping a developer 109 and a developing sleeve 105 as a developer carrying member and functions to supply the developer 109 to the latent image formed on the photosensitive drum 111 to visualize it. Adjacent to the developing sleeve 105, a development blade 107 as a developer regulating member is provided. Between the photosensitive drum 111 and the developing sleeve 105, a bias supplying voltage source (not shown) is connected to supply a proper developing bias.

The image thus visualized with the developer 109 is transferred from the photosensitive drum 111 onto a transfer material 114 by a transferring device 110. The transfer material 114 is supplied by sheet feeding rollers 116, and is fed to the transferring device 110 in timed relation with the image on the photosensitive drum 111. The visualized image now transferred onto the transfer material 114 is transported to a fixing device 115 with the transfer material 114, where it is fixed by heat or pressure. The developer remaining on the photosensitive drum 111 without being transferred, is removed from the photosensitive drum 111 by a cleaning device 112 having a blade 113, so that the surface of the photosensitive drum is charged again by the charging device 103 to repeat the above-described process.

FIG. 15 shows an apparatus using a magnetic one component developer as example of the developing device usable with the image forming apparatus. In FIG. 15, designated by **105*b* is a non-magnetic developing sleeve as a developer carrying member formed from an aluminum or stainless steel pipe. Therein, there is a magnet roller 105*a* having magnetic poles N and S, and the magnet roller 105*a* is stationary. An elastic blade 107*a* of rubber (e.g. urethane rubber, silicone rubber or the like) or of metal leaf spring or the like, supported on a supporting metal plate 107*b* is contacted to the developing sleeve 105*b* with a predetermined pressure as a developer regulating member. The toner 109 as the developer attracted to the developing sleeve 105*b* by the magnetic force is regulated in the amount thereof by the elastic blade 107*a* portion, and after that, it is rubbed between the developing sleeve 105*b* and the elastic blade 107*a*** to be subjected to a triboelectric charge to acquire an appropriate charge and then is fed to a developing zone.

Conventionally, the magnet roller **105*a* has a plurality of magnetic poles including a toner carrying pole S2 for carrying and transporting the magnetic toner 109 in the container 104, a developing pole S1 at a position facing to the photosensitive drum 111** for preventing fog, a blow prevention pole N2 for preventing toner blow at the bottom of the developing sleeve, and as the case may be, a pole N1 for preventing toner scattering.

By using the magnet roller **105*a***, various advantages are provided, for example; the magnetic one component type developing device is a simple structure, and its cost is low, and in addition, toner scattering is not significant.

FIG. 16 shows an example of a developing device using a non-magnetic one component developer. In this developing device, no magnet roller is required in the developing sleeve **105*b*, but it is necessary to contact an elastic roller 121 of a sponge material or the like to the sleeve 105*b*** to apply it while providing a triboelectric charge. This is disadvantageous in that the cost is increased, and the required torque is increased.

From the standpoint of simple structure, the magnetic one component developer is preferable.

However, the developing device using the magnetic one component developer involves the following problem. The magnetic toner forms chains of a height corresponding to 10–20 layers of the toner particles along the magnetic force lines formed by the magnet, and they behave in the form of chains in the developing process, and therefore, the toner particles are deposited onto the electrostatic latent image on photosensitive member in the form of chains, with the result of trailing and/or scattering.

In view this, the trailing and scattering is decreased by loosening the chains of the toner by formation of an AC electric field between the sleeve and the drum, or by proving S- and N-poles upstream and downstream of a position where the developing pole is faced to the photosensitive member to effect the development with the lying chains.

However, when the AC electric field between the sleeve and the drum is increased, the problem of increasing fog arises, and even if the developing pole is disposed between magnetic poles, the chains of the toner is not sufficiently removed.

A description will be made as to the fog in the case of reverse development wherein a negative latent image is reversely developed with negative charged toner. FIG. 17 show a relation between a potential of the electrostatic latent image on the photosensitive drum and a developing bias applied to the sleeve. On the drum, a white portion potential Vd=−700V, and printing portion potential Vl=−150V, the sleeve is supplied with a bias voltage of Vdc=−500V superimposed with an AC (Vpp=1600 and f=1800 Hz). Here, the drum and the sleeve are faced to each other with a clearance of 300 μm therebetween at the closest position. On the sleeve, there are regular toner of negative charging and reversely charged toner of positive charging (opposite polarity). This is because even if the toner is negatively chargeable toner, the reversely charged toner exists due to the triboelectric charge among toner particles. When the AC is superposed, the fog producing electric field applied to the toner increases, and therefore, both of the regular toner and the reversely charged toner reach to the white portion with the result of the possibility of the fog production, as shown in FIG. 17. This development is enhanced with an increase of the triboelectric charge of the toner. When the developing bias contains only DC, the developing electric field causing the fog is small, as shown in FIG. 18, and therefore, the fog toner hardly reaches to the white portion potential.

In a developing device, an elastic blade is contacted to the sleeve for the purpose of increasing the triboelectric charge of the toner to increase the development efficiency thus raising the image density. In such a device, the toner is rubbed with the sleeve to triboelectrically charge the toner. The effect of tile triboelectric charge with the blade is enhanced by using the material of the surface of the elastic blade having a triboelectric charge property of the polarity opposite from the toner. By doing so, the toner triboelectric charge is increased so that the development efficiency is increased, thus sufficiently increasing the image density, and simultaneously, the image quality is improved. However, when the development property is enhanced, fog increases, too.

Particle size reduction of the toner would be considered for the purpose of improving the image quality, but then, the uniform triboelectric charge application to the toner tends to become difficult.

As a countermeasure, the magnetic field provided by the developing pole of the magnet roller faced to the drum is increased to increase the force for toner back-transfer. However, there is a limit because of the problems arising from the magnet roller material and the manufacturing methods. In some cases, the chain is elongated with the result of worsening of the trailing and the scattering, and therefore, the decrease of the density.

The magnetic toner reciprocations between the sleeve and the drum while maintaining a certain extent of the chain state, and therefore, it would be possible that the reversely charged toner and low triboelectric charged toner reaches the drum together with the regular toner, and therefore, the density increase leads to an increase of the fog.

SUMMARY OF THE INVENTION

Accordingly, it is a principal object of the present invention to provide a developing device of a magnetic one component type wherein trailing and scattering are prevented.

It is another object of the present invention to provide a developing device of a magnetic one component type wherein the fog is reduced.

It is a further object of the present invention to provide magnetic toner is presented for the development without erection of chains.

According to an aspect of the present invention, there is provided a developing device includes a developer container for accommodating one component magnetic toner; a rotatable toner carrying member, faced to an image bearing member for bearing an electrostatic image to form a developing zone therebetween, for carrying the toner in the container; a magnet member in the toner carrying member: a regulating member, elastically urged to the toner carrying member to form a nip therebetween, for regulating a toner layer thickness on the toner carrying member; wherein the magnet member has a magnetic pole, upstream of the nip with respect to a movement direction of the toner carrying member, for supplying the toner in the container to the toner carrying member, and wherein the magnet member does not generate a magnetic field effective for chain erection of the toner in a range from an upstream end of the nip to a downstream end of the developing zone.

These and other objects, features and advantages of the present invention will become more apparent upon a consideration of the following invention taken in conjunction with the accompanying drawings.

DESCRIPTION OF THE PREFERRED EMBODIMENT

Referring to the accompanying drawings, the embodiments of the present invention will be described.

(First Embodiment)

Figure 1:
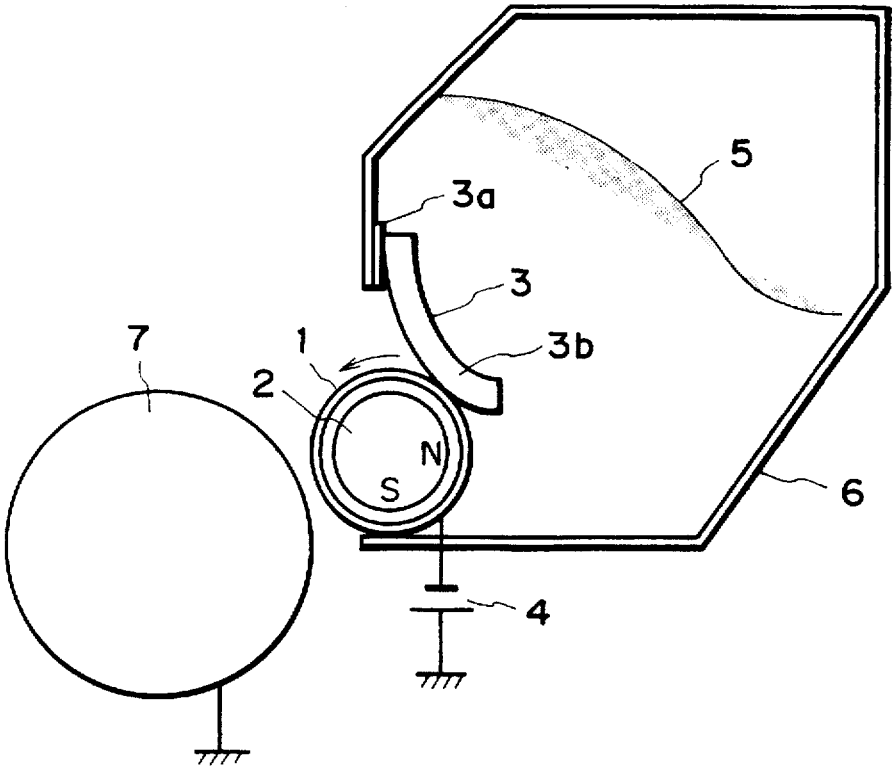
FIG. 1 is a sectional view of a developing device according to a first embodiment of the present invention.
Figure 2:
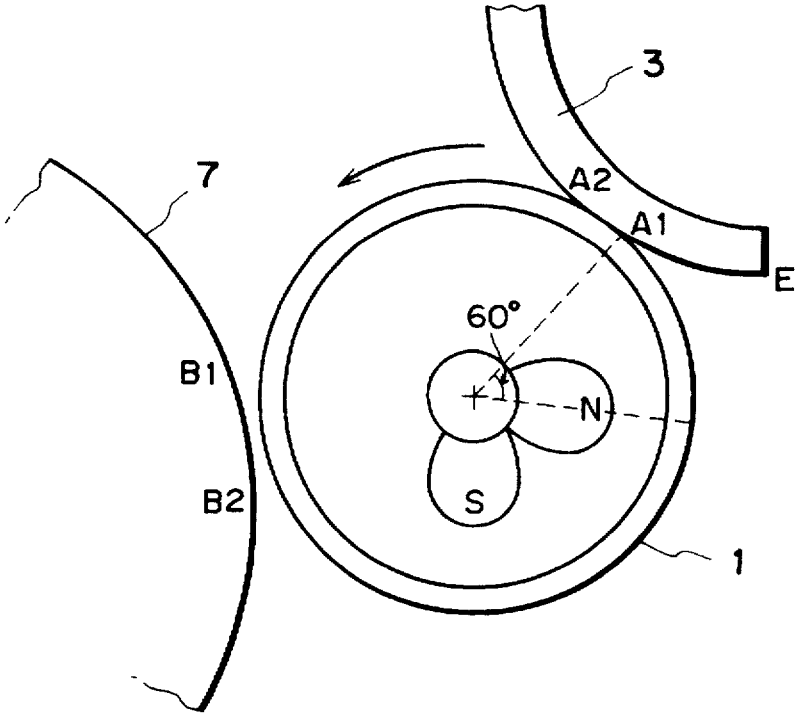
FIG. 2 shows a magnet roller in the first embodiment.

FIG. 1 is a sectional view of a developing device according to a first embodiment of the present invention, wherein the feature thereof is best seen, and FIG. 2 shows a magnetic pole arrangement of the magnet.

In FIG. 1, designated by 1 is a developing sleeve functioning as the developer carrying member, and a development blade **3*b* of elastic material functioning as a developer regulating member 3 is press-contacted to the developing sleeve 1 to form a nip for regulating the layer thickness of the one component magnetic toner. A magnet roller 2 for producing a magnetic field for carrying the toner is stationarily disposed in the developing sleeve 1. The magnet roller has magnetic poles in a range from the contact position between the development blade 3*b* and the sleeve 1 to the opposing position (developing zone) relative to the photosensitive member 7 in the rotational direction of the sleeve 1. The magnet roller 2 has two poles, namely, a toner carrying pole N for supplying the toner to the developing sleeve, and a blow prevention pole S for preventing the leakage of the toner. The magnet roller 2 functions to supply and feed the toner 5 from the developing container 6. FIG. 2 shows a relation among a magnetic flux density distribution in the direction of the normal line relative to the magnet roller 2**, a blade contact position and the position where it is faced to the photosensitive member.

The developing container 6 contains the one component magnetic toner 5, which is stirred and then fed to the neighborhood of the developing sleeve 1. The thus fed toner is attracted by the magnetic field formed by the magnet roller 2 and is conveyed with the rotation of the developing sleeve 1. It is triboelectrically charged by the friction and is subjected to layer thickness regulation in the nip between the development blade 3 and the sleeve, and then, is fed into the developing zone.

However, it is to be noted that there is no magnetic pole of the magnet roller 2 from the nip between the development blade 3 and the sleeve 1 to the opposing position (developing zone) between the photosensitive member 7 and the sleeve 1 in the rotational direction of the sleeve 1, and therefore, the toner is not erected. The developing sleeve 1 is supplied with a DC bias to form a developing electric field between itself and the photosensitive member 7, and the electrostatic latent image is developed with the toner fed into the developing zone without disturbance in accordance with the electric field.

This embodiment will be described in detail on the basis of the specifical data. In this embodiment, reverse development is carried out for a negative latent image on the photosensitive member using negative charged toner.

The developing sleeve 1 comprises a non-magnetic aluminum sleeve having a diameter of 16.0 mm and a coating thereon, which is a resin material electroconductive layer having a surface containing electroconductive powder containing carbon. It had an average surface roughness of Ra=2.0 μm.

As for the development blade 3, an urethane rubber 3*b* was fixed to a supporting member 3*a* of metal plate, and then, fixed to the developing container 6 to provide press-contact to the developing sleeve 2 at the line pressure of 10 gf/cm approx. The width of contact between the sleeve 1 and the blade 3 (nip) A1–A2 was 1.0 mm, and the distance from the most upstream point A1 of the contact to the blade free end E was 2.0 mm.

The toner carrying pole N of the magnet roller 2 provides a peak of the magnetic flux density of 65 mT in the normal line direction (sleeve surface position). An angle between the toner carrying pole N and the blade contact position A1 was 60°, which was 8.4 mm in the distance measured on the surface of the sleeve. The blow prevention pole S is disposed adjacent the bottom portion of the developing container and provides a peak of the magnetic flux density of 65 mT in the normal direction.

The toner used had a volume average particle size of 8.0 μm approx. and was a magnetic one component toner having a negative charging property. The toner contains 100 parts by wt. of magnetic material relative to the binder resin material.

The developing sleeve 1 is supplied with a developing bias 4 of DC voltage of Vdc=−600V. Between the sleeve 1 and the photosensitive member 7, there is a gap of 100 μm at the closest position. The toner on the sleeve is capable of effecting development within a range (development width of B1–B2) of 2.0 mm with the closest position at the center.

The photosensitive member 7 is subjected to uniform charging to acquire the k0 charge potential of Vd=−700V, and it is exposed to laser beam in accordance with the image signal. The exposed portion has a potential of Vl=−150V. Then the V part of is reversely developed by the negative charging property toner.

With this system, the toner coating amount M/S=1.5 mg/cm$^2$ on the sleeve 1. The average triboelectric charge was Q/M=−7.0 μc/g.

The chain of the toner particles does not erect, because there is not magnetic pole of the magnet roller 2 from the most upstream point A1 of the contact between the development blade 3 and the sleeve 1 to the opposing position (developing zone) between the sleeve 1 and the photosensitive member 7 in the rotational direction of the sleeve 1.

With the non-contact DC development using magnetic one component toner as in this embodiment, the developing electric field cannot be very strong, and therefore, it is desirable that the triboelectric charge of the toner in the toner layer is low. In this embodiment, since the developing electric field is unidirectional (DC electric field), the fog hardly occurs even if reversely charged toner exists.

Figures 3, 4:
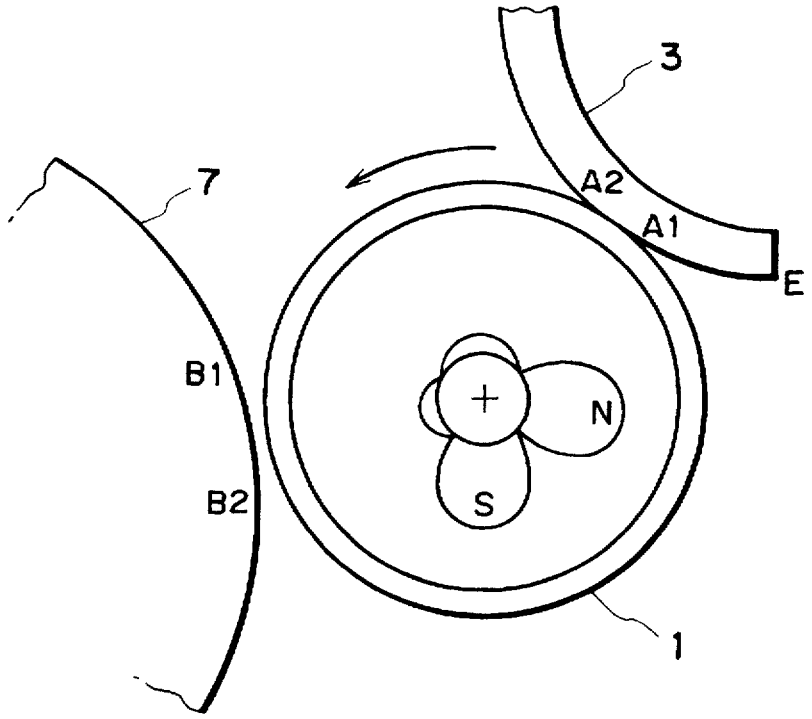
FIG. 3 illustrates an effect of the first embodiment.
FIG. 4 shows a magnet roller of a first embodiment.

Between the toner coating amount on the sleeve 1 and the image quality, there is a relation as shown in FIG. 3. The evaluation of the image quality is such that reflection density of 1.40 or higher is F or G, and that fog of 8% or lower on the drum is F or G. Te scattering was checked on the basis of device inside contamination after 10000 sheets prints. The substantial supply amount of the toner to drum is expressed by $$(M/S)\times(Vs/Vp)$$

where M/S is a toner amount on the sleeve, Vs is the sleeve peripheral speed, and Vp is the drum peripheral speed.

It has been found that density insufficiency results if the substantial supply amount (M/S)×(Vs/Vp) is smaller than 1.0 mg/cm$^2$, and the fog is produced if it is larger than 2.5 mg/cm$^2$. Therefore, it is preferable that the substantial supply amount of the toner to the photosensitive member is not less than 1.0 mg/cm$^2$ and not more than 2.5 mg/cm$^2$ by proper formation of the toner coating a mount M/S on the sleeve.

There is an interrelation between the trailing and scattering of the toner at the edge of a line image and a toner coating amount M/S on the sleeve. If M/S equals 1.5 mg/cm$^2$, the trailing and scattering characteristics are well within the good G range. Accordingly, the toner coating amount on the sleeve is preferably not more than 1.5 mg/cm$^2$, and the substantial supply amount is not less than 1.0 mg/cm$^2$, and not more than 2.5 mg/cm$^2$.

The investigations were made as to a relation between the image quality and the magnet rollers. The preparation was made with a magnet roller having a magnetic pole of small magnetic force within a range from the most upstream point A1 of the contact between the development blade 1 and the sleeve 3 to the lower limit position B2 of the developable width in the opposing position (developing zone) between the photosensitive member 7 and the sleeve 1 in the rotation direction of the sleeve 1.

It has been confirmed that even if there is a magnetic pole as shown in FIG. 4, the magnetic field thereby is so weak that the chains of the toner particles are hardly formed, and therefore, the effects of this embodiment are provided, if the magnetic flux density is not more than 20 mT. However, if the magnetic flux density on the sleeve exceeds 20 mT, the influence of the chain erection gradually appears with the result of deterioration of the image quality.

In the case of non-contact blade 3, the toner layer regulation is not possible without the magnetic force with the result of density insufficiency and scattering, and therefore, the contact to the sleeve 1 is desirable.

In this embodiment, there is no magnetic pole of the magnet roller 2 in the range from the contact position between the development blade 3 and the sleeve 1 to the lower limit position of development width of the developing zone where the sleeve 1 is faced to the photosensitive member 7, in the rotation rotation of the sleeve 1, or the magnetic flux density on the sleeve 1 in the normal line direction is not more than 20 mT, by which the toner does not form a chain at the blade contact portion; and downstream thereof to the developing zone, the chain erection of the toner does not occur since the influence of the magnetic field is small. As a result, the particles behave individually in the developing zone. As compared with the conventional device, the trailing or the scattering of the toner is suppressed, thus accomplishing high image quality development.

In the developing container, similarly to the conventional example, the toner is attracted to the sleeve by the magnetic field provided by the magnet and is conveyed, and therefore, there is not need of doner roller for the toner unlike the non-magnetic toner type developing device, and therefore, the cost increase can be avoided.

(Second Embodiment)

Figures 5, 6:
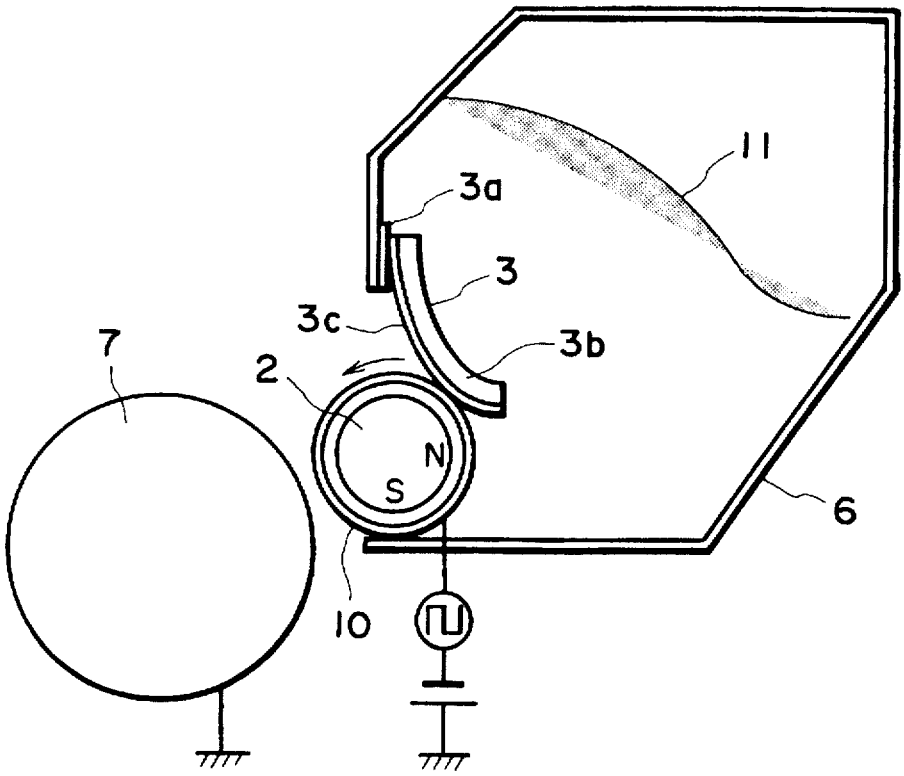
FIG. 5 is a sectional view of a developing device according to a second embodiment of the present invention.
FIG. 6 illustrates an effect of the second embodiment.

In this embodiment, the present invention is used in an apparatus wherein AC+DC is applied as the developing bias. With the AC bias superimposing type, the toner particles having high triboelectric charge can be used for the development, and the graininess of the image is improved, thus providing a sliding image quality. FIG. 5 is a sectional view of a developing device of this embodiment.

In FIG. 5, the fundamental structure is the same as that of the first embodiment. However, since the AC superimposing type tends to produce fog and since it tends to cause toner scattering, it is desirable to increase the triboelectric charge at the development blade portion and to decrease the toner feeding force of the developing sleeve. Since there is hardly any influence of the magnetic field of the magnet from the contact position between the development blade and the sleeve to the opposing position (developing zone) relative to the photosensitive member in the rotation direction of the sleeve, the chain erection of the toner particles occur. The developing sleeve is supplied with an AC+DC bias to form a developing electric field between the photosensitive member and the developing sleeve to effect the development of the electrostatic latent image in accordance with the electric field.

The embodiment will be described with actual examples. The developing sleeve 10 comprises a non-magnetic aluminum sleeve having a diameter of 16.0 mm and a coating thereon, which is a resin material electroconductive layer having a surface containing carbon. It had an average surface roughness of Ra=0.5 μm.

As for the development blade 3, an urethane rubber 3*b* coated with Nylon resin material 3*c* having an opposite charging property from that of the toner was fixed to a supporting member 3*a* of metal plate, and then, is fixed to the developing container 6 to provide press-contact to the developing sleeve 10 at the line pressure of 20 gf/cm approx. The distance between the blade free end and trailing edge of the sleeve contact portion relative to the blade 3 is 1.0 mm. The magnet roller 2 was the same as in FIG. 2.

The toner 11 used was a negative one component toner having a volume average particle size of 6.0 μm approx. The toner contains 100 parts by wt. of the magnetic member relative to the binder resin material. With this system, the toner coating amount M/S=0.8 mg/cm$^2$ on the sleeve. The average triboelectric charge is Q/M=−1.50 μc/g.

Since there is hardly any influence of the magnetic field of the magnet roller 2 in the range from the contact position between the development blade 3 and the sleeve 10 to the opposing position (developing zone) with the photosensitive member 7 in the rotation direction of the sleeve 10, the toner chain erection does not occur.

The developing sleeve is supplied with a developing bias of a DC voltage of Vdc=−500V biased with an AC of rectangular wave having Vpp=1600V and f=1800 Hz. A gap of 300 μm is formed between the sleeve 10 and the photosensitive member at the closest position therebetween.

The photosensitive member 7 is subjected to uniform charging of k0 charge potential Vd=−700V, and is exposed to a laser beam in accordance with image signal, and the potential of the exposed portion becomes V1=−150V, and the V1 part of is reversely developed with the negative charging property toner.

Between the toner coating amount on the sleeve and the image quality, there is a relation as shown in FIG. 6. It has been found that density insufficiency results if the substantial supply amount (M/S)×(Vs/Vp) is smaller than 0.6 mg/cm$^2$, and the fog is produced if it is larger than 1.5 mg/cm$^2$. Therefore, it is preferable that the substantial supply amount of the toner to the photosensitive member is not less than 0.6 mg/cm$^2$ and not more than 1.5 mg/cm$^2$ by proper formation of the toner coating amount on the sleeve. In order to suppress the trailing and scattering to a satisfactory extend, the toner coating amount M/S on the sleeve is desirably not more than 1.5 mg/cm$^2$. Accordingly, the toner coating amount on the sleeve is preferably not more than 1.5 mg/cm$^2$, and the substantial supply amount is not less than 0.6 mg/cm$^2$ and not more than 1.5 mg/cm$^2$.

Figure 7:
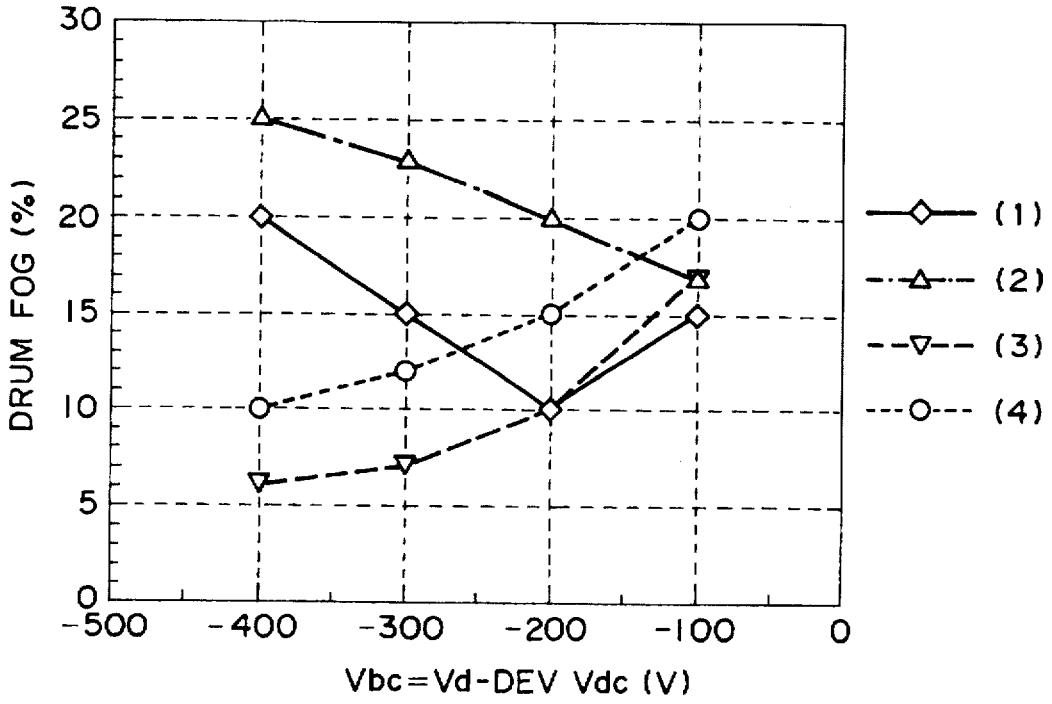
FIG. 7 illustrates an effect of the second embodiment.

The effect of fog prevention of this embodiment will be described with a comparison example. The fog on the drum is taken up with a non-color tape, and is stuck on a paper to measure the degree of fog. FIG. 7 shows the fog level on the drum relative to the back contrast Vbc= (white portion potential Vd on the drum-development Vdc). From FIG. 7, the following is understood.

Figure 8:
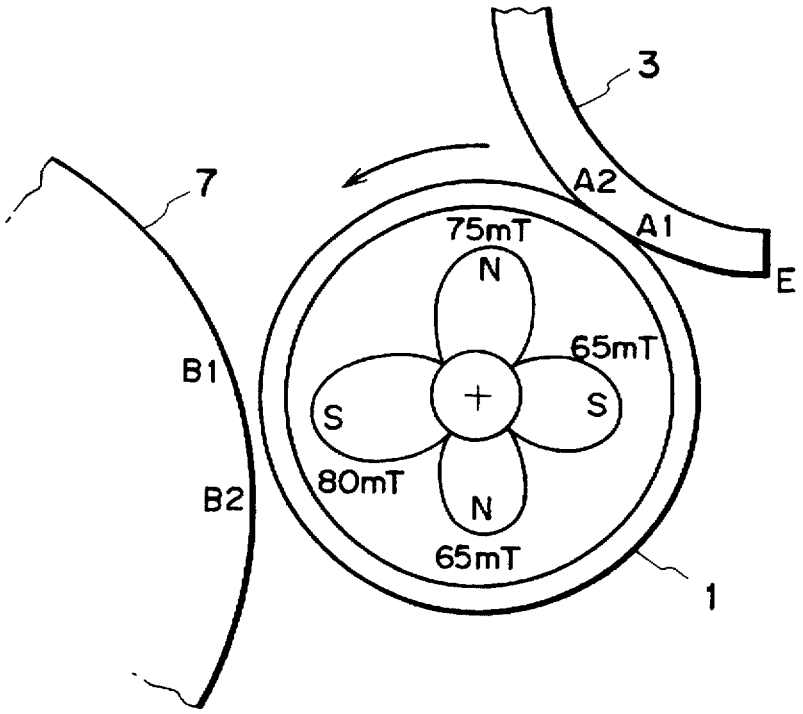
FIG. 8 shows a magnet roller in a comparison example relative to the second embodiment.

1. Similarly to a conventional general structure, a magnet roller having a magnetic pole positioning as shown in FIG. 8 is used, and the developing pole is disposed at a position faced to the photosensitive member, and the peak of the magnetic flux density in the normal line direction is 80 mT. In this case, the fog is not sufficiently decreased, as shown in FIG. 7(1).

Figure 9:
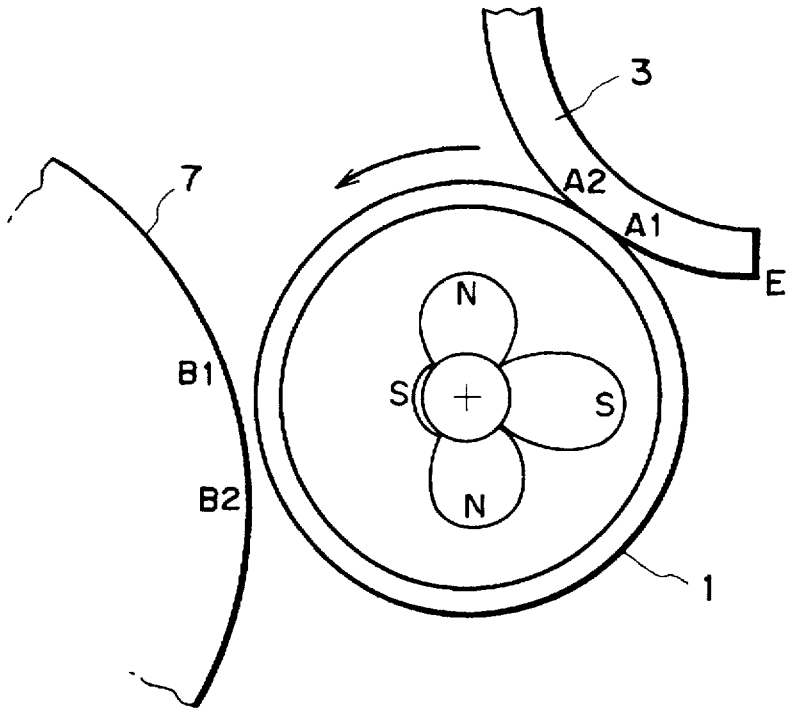
FIG. 9 shows a magnet roller of a comparison example relative to the second embodiment.

2. In the case that a magnet roller having a magnetic pole positioning as shown in FIG. 9 is used, and the developing pole at the position faced to the photosensitive member only is reduced, the fog significantly increases. The reason for this is considered as follows: the back-transfer magnetic force by the developing pole is decreased, the uniform triboelectric charge application is not possible by the elastic blade contact portion due to the magnetic force of the magnet, and the chains of the toner are formed by the magnetic pole after the blade so that the chains are not sufficiently loosened.

3. When the use is made with the magnet roller having the magnetic pole positioning as shown in FIG. 2, the fog is significant when Vbc is small, but if Vbc is not less than 300V, the fog can be decreased sufficiently.

4. Even if the magnet having the magnetic pole positioning as shown in FIG. 2 is used, the fog is increased as shown in FIG. 7(4) when the toner coating amount on the sleeve is large. In this comparison example, the surface roughness of the sleeve is increased, and the toner coating amount M/S= 2.0 mg/cm$^2$.

As will be understood from the foregoing, the sleeve surface roughness is made proper by the elastic blade coating so that the toner coating amount M/S on the sleeve is to provide the substantial supply amount (M/S)×(Vs/Vp) to the drum is not less than 0.6 mg/cm$^2$ and not more than 1.5 mg/cm$^2$, and the influence of the magnetic field of the magnet roller from the contact position between the development blade and sleeve to the opposing position (developing zone) relative to the photosensitive member in the rotational direction, is decreased, by which a thin layer of high triboelectric charge toner particles are formed on the sleeve, so that reversely charged toner can be reduced, so that the toner particles behave independently in the developing zone, and therefore, the fog due to the reversely charged toner or the low triboelectric charged toner can be reduced. Additionally, the toner scattering, trailing are reduced to permit high quality image formation.

In this embodiment, use is made with an elastic blade having a surface of a material having a charge polarity opposite from that of the or the like is used, but this is not limiting. An urethane rubber blade as in the first embodiment, is usable with similar contact pressure. The following is effective.

Figure 10:
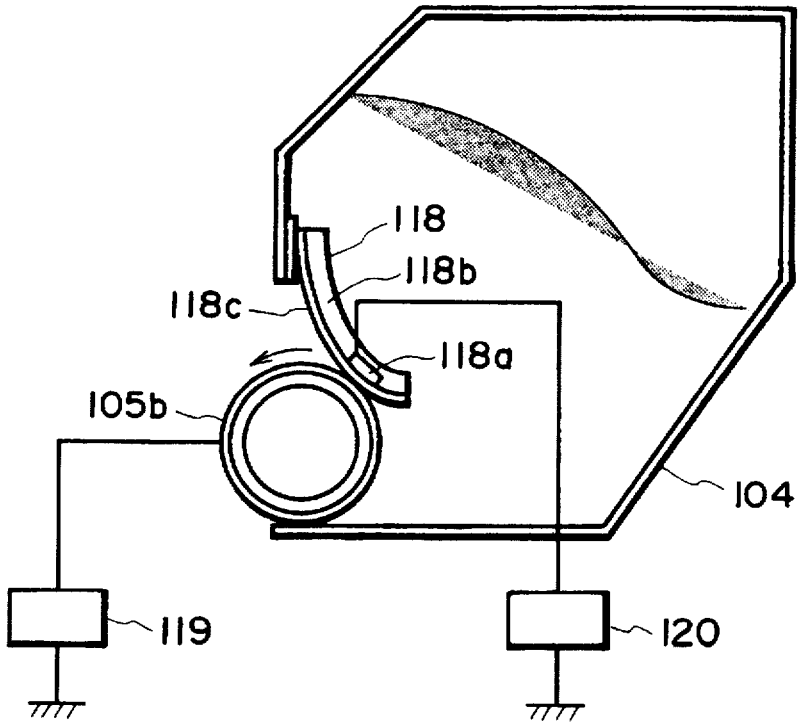
FIG. 10 is a sectional view of a developing device of a second embodiment.

In a developing device of FIG. 10, the main body of the elastic blade is of insulative material such as urethane, and the surface thereof is provided with an electrode 118*a* of an electroconductive material such as carbon dispersed Nylon. At least the developing sleeve 105*b* side surface of the elastic blade is coated with a high resistance layer 118*c* of urethane resin material or the like. The elastic blade 118*b* is contacted to the developing sleeve 105*b* counterdirectionally.

The developing sleeve 105*b* is supplied with a developing bias from a voltage source 119. The electrode 118*a* is supplied with a predetermined bias voltage from a bias voltage source 120 for the blade. The high resistance layer 118*c* of the elastic blade 118*b* functions to prevent the leakage between the electrode 118*a* and the developing sleeve 105*b*.

Between the electrode 118*a* of the elastic blade 118 and the developing sleeve 105*b*, alternating electric field is formed by the blade bias from the voltage source 120, so that the toner particles therebetween reciprocate between the blade and the sleeve. By this arrangement, the chances of toner contact to or removal from the sleeve are increased, thus increasing the charging efficiency of the toner, and in addition, the reversely charged toner is decreased. By using such a development blade, the efficiency of this embodiment is further improved.

(Third Embodiment)

Figure 11:
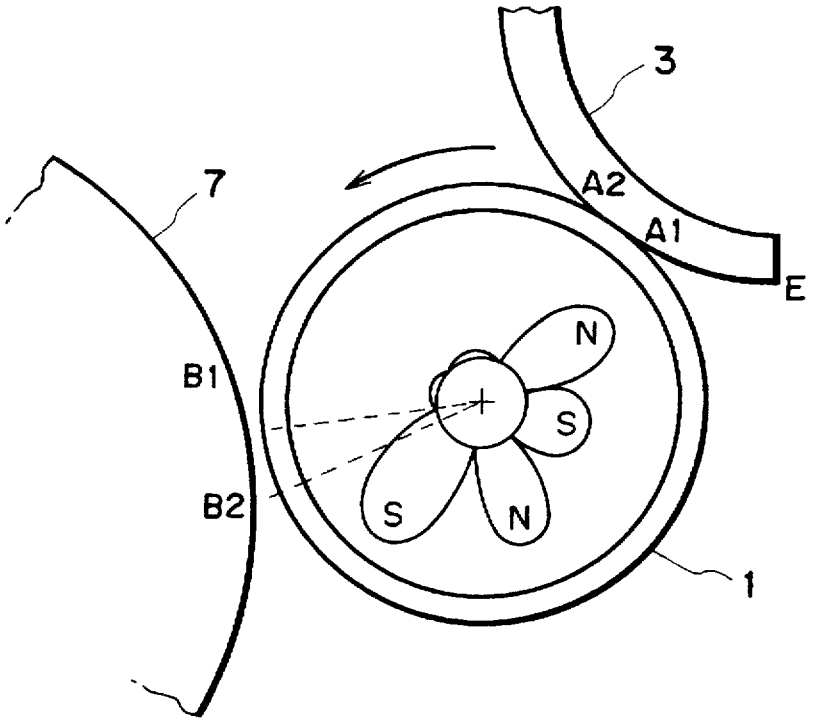
FIG. 11 shows a magnet roller according to a third embodiment of the present invention.

This embodiment is effective to further improve the fog prevention in a developing device using AC+DC as the developing bias. The fundamental structure of the developing device is the same as in the second embodiment, but the structure of the magnet is changed for further reduction of the fog. FIG. 11 shows a magnetic pole positioning of the magnet.

The embodiment will be described with an actual example. The same structure as of the second embodiment was used except for the magnet. The toner carrying pole N of the magnet roller provides 65 mT (sleeve surface position) of the peak of the magnetic flux density in the normal line direction, and the angle between the toner carrying pole N and the blade contact position A1 is 60°, namely, the distance therebetween measured on the surface of the sleeve is 8.4 mm. Blow prevention pole S is disposed adjacent the bottom of the developing container (the peak of the magnetic flux density in the normal line direction is 65 mT)

Since the influence of the magnetic field of the magnet roller from contact position between the development blade and the sleeve to the opposing position (developing zone) relative to the photosensitive member in the rotation direction of the sleeve is small, the toner chain erection does not occur. In this embodiment, there is provided a magnetic pole providing 80 mT peak of the magnetic flux density in the normal line direction of the sleeve surface at a position 40° downstream of the position where the sleeve is faced to the photosensitive member. By doing so, the magnetic flux density in the normal line direction on the sleeve is 40 mT approx. in the electrode region portion after the closest position between the developing sleeve and the photosensitive member, and therefore, the toner can be pulled back by the magnetic force. A magnetic field is formed in a part of of the developing zone, but the position thereof is downstream of the closest point, and therefore, the toner is not formed into a chain by the function of the AC bias so that the trailing and scattering are not increased.

However, in the non-contact DC development type, the chain erection of the toner occurred if this magnet roller is used with the result of increase of trailing and scattering.

As regards the coating amount M/S of the toner, if the substantial supply amount (M/S)×(Vs/Vp) to the drum was less than 0.5 mg/cm$^2$, the density insufficiency resulted, and if it was larger than 1.5 mg/cm$^2$, the toner scattering occurred.

Figure 12:
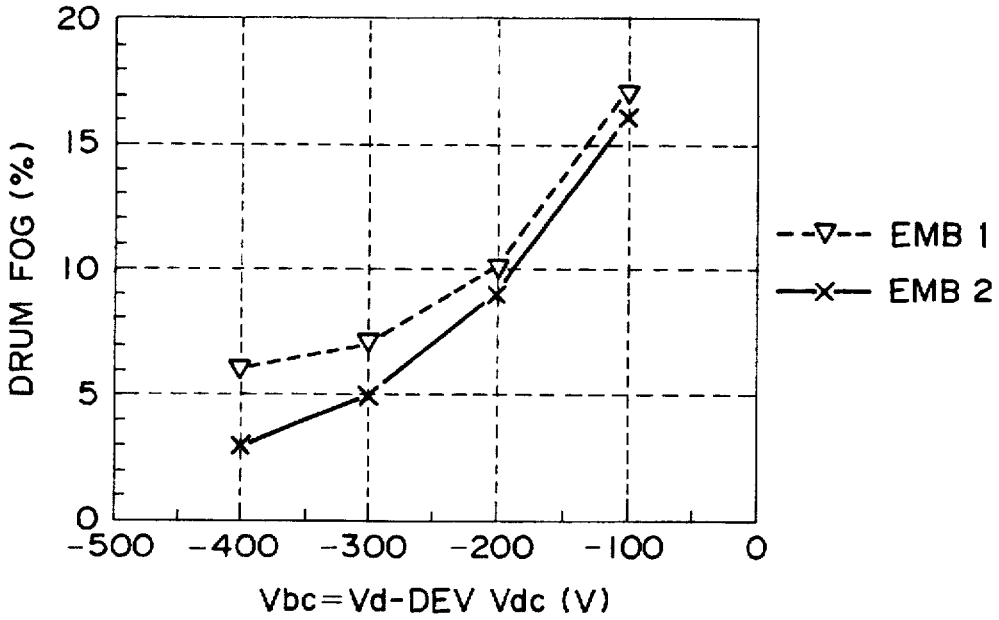
FIG. 12 illustrates an effect of the third embodiment.

FIG. 12 shows a relation between a back contrast Vbc= (white portion potential Vd on the drum-development Vdc) and the fog on the drum. It will be understood that the effect of the fog reduction is more remarkable than in the second embodiment.

As will be understood from the foregoing, the sleeve surface roughness is made proper by the elastic blade coating so that the toner coating amount M/S on the sleeve is to provide the substantial supply amount (M/S)×(Vs/Vp) to the drum is not less than 0.6 mg/cm$^2$ and not more than 1.5 mg/cm$^2$, and the influence of the magnetic field of the magnet roller from the contact position between the development blade and sleeve to the opposing position (developing zone) relative to the photosensitive member in the rotational direction, is decreased, by which a thin layer of high triboelectric charge toner particles are formed on the sleeve, so that reversely charged toner can be reduced, so that the toner particles behave independently in the developing zone, and therefore, the fog due to the reversely charged toner or the low triboelectric charged toner can be reduced. Additionally, high quality images can be formed without toner scattering and trailing.

(Fourth Embodiment)

In this embodiment, the developing device using the magnet roller according to any one of the foregoing embodiments, is incorporated in an exchangeable integral type cartridge wherein the service life of the developing device is substantially the same as another means therein.

Figure 13:
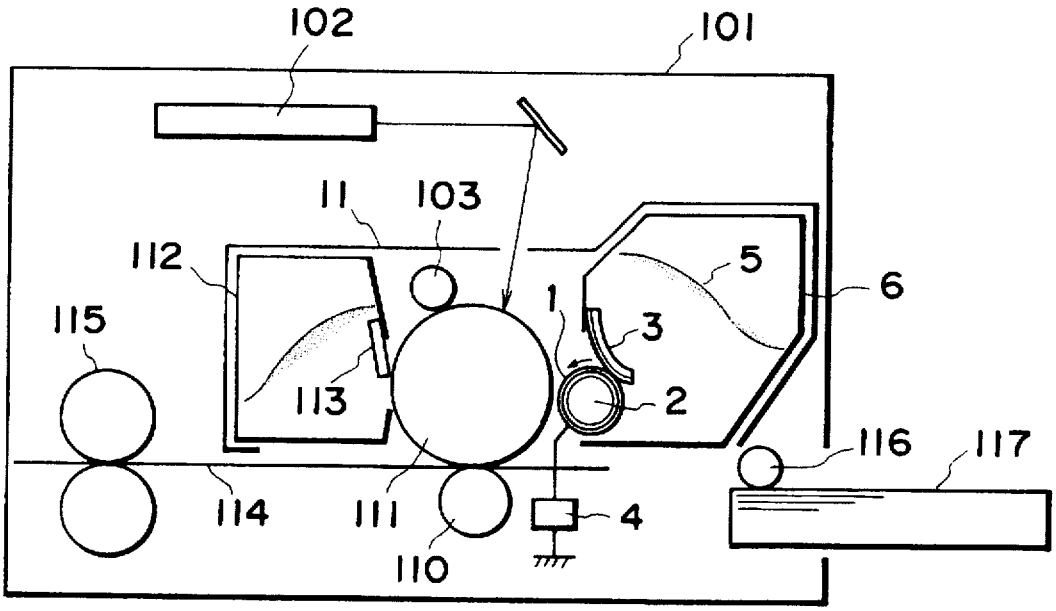
FIG. 13 is a sectional view of a cartridge and an image forming apparatus according to a fourth embodiment of the present invention.
Figure 14:
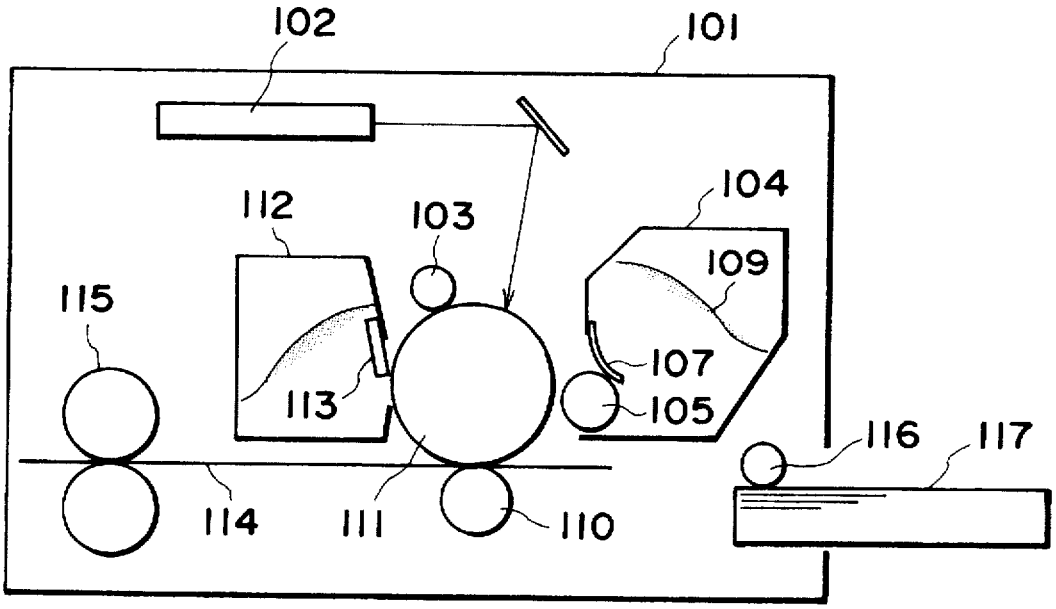
FIG. 14 PRIOR ART
FIG. 14 is an image forming apparatus of a conventional example.
Figure 15:
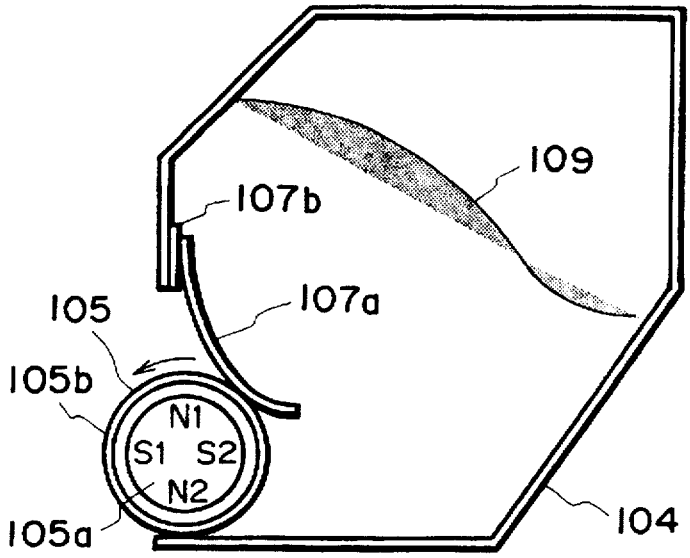
FIG. 15 PRIOR ART
FIG. 15 is a developing device of a conventional example.
Figure 16:
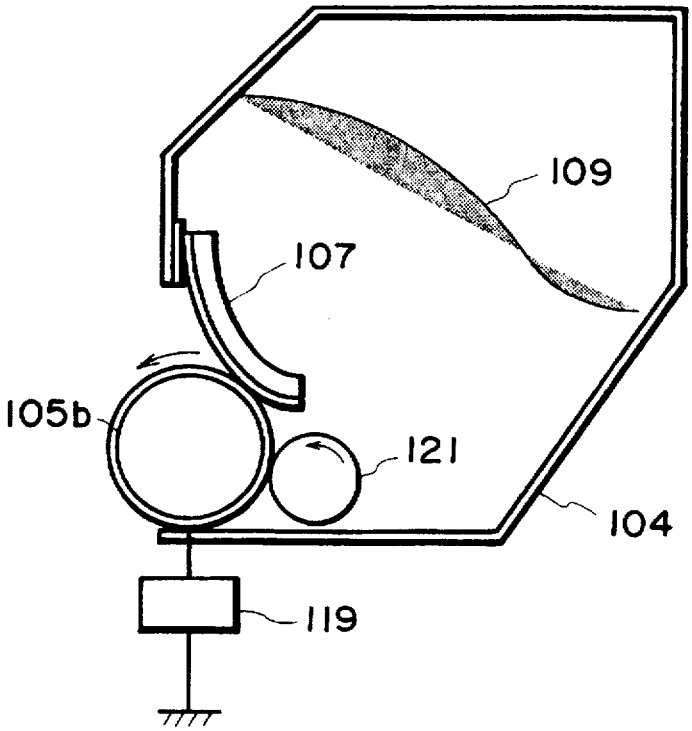
FIG. 16 PRIOR ART
FIG. 16 is a developing device of a conventional example.
Figure 17:
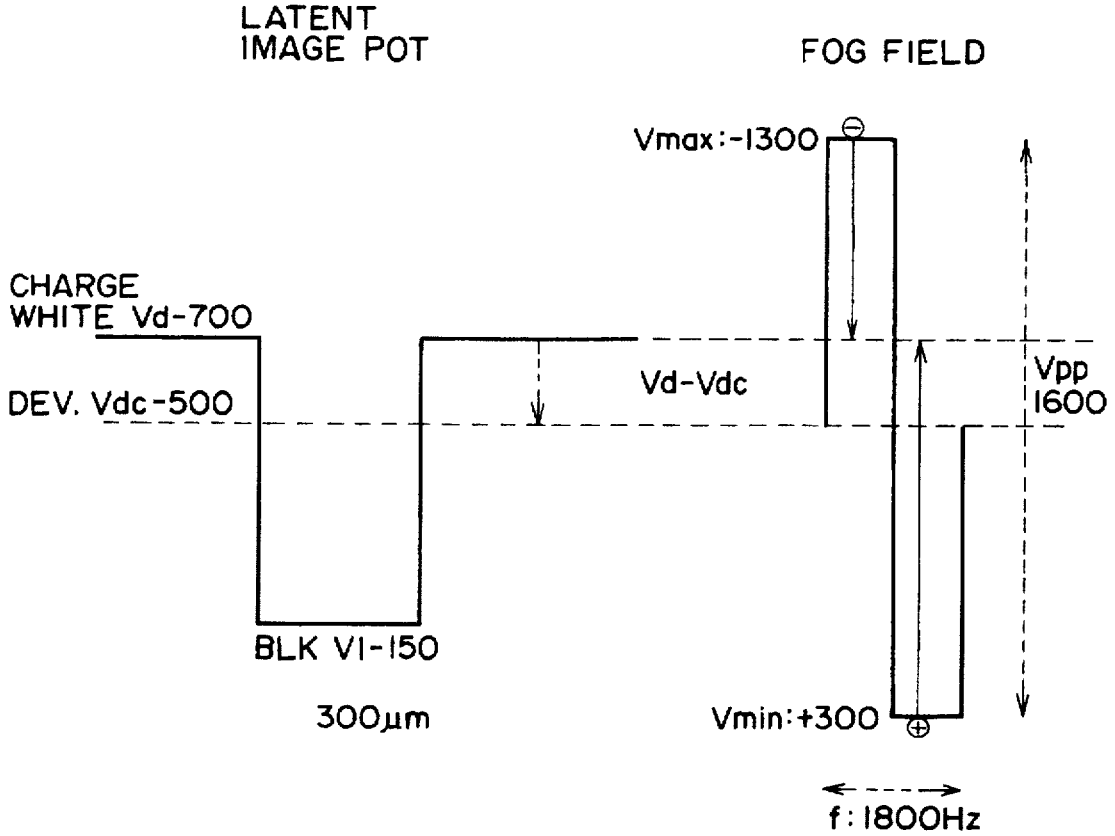
FIG. 17 illustrates a potential during image formation.
Figure 18:
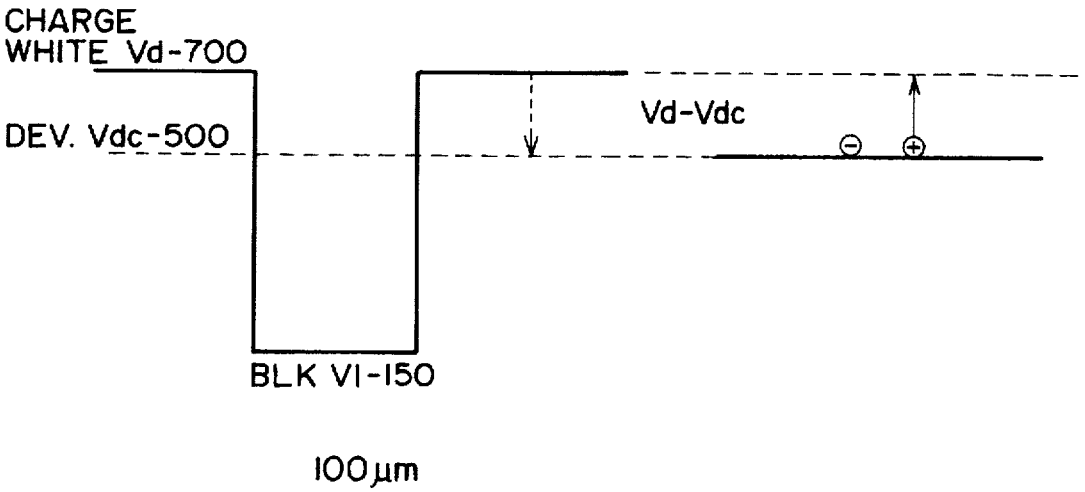
FIG. 18 illustrates a potential during image formation.

FIG. 13 shows example of an image forming apparatus using the integral type cartridge. The same reference numerals as in the foregoing embodiments are assigned to the elements having the corresponding functions, and detailed descriptions thereof are omitted for simplicity. In this embodiment, the developing device provided with the developing sleeve 1, the magnet roller 2, the development blade 3, the bias voltage source 4, the toner 5, and the developing container 6; the photosensitive drum 111; the cleaning device 112 having blade 113; and the charging device 103, are integrated by a frame 11 into an integral type cartridge. In the case of the integral type cartridge, when the toner 5 is used up, the service lives of the other means are also substantially reached. Thus, as long as the cartridge contains the toner, stabilized images can be always provided. Because it is an unit type, the exchange is easy. Since the magnet roller of this invention is used in the developing device, the structure of the magnet roller is simple in the cartridge, and therefore, the manufacturing step is simplified, and the manufacturing cost is reduced, and the device inside contamination due to the toner scattering is suppressed, in addition to the advantages of the integral type cartridge structure.

While the invention has been described with reference to the structures disclosed herein, it is not confined to the details set forth and this application is intended to cover such modifications or changes as may come within the purpose of the improvements or the scope of the following claims.

What is claimed is:

1. A developing device comprising:

a developer container for accommodating one component magnetic toner;

a rotatable toner carrying member, faced to an image bearing member for bearing an electrostatic image to form a developing zone therebetween, for carrying the toner in said container;

a regulating member, elastically urged to said toner carrying member to form a nip therebetween for regulating a toner layer thickness on said toner carrying member;

a magnet member in said toner carrying member, wherein said magnet member has a magnetic pole, upstream of the nip with respect to a movement direction of said toner carrying member, for supplying the toner in said container to said toner carrying member;

wherein a magnetic flux density in a normal line direction on said toner carrying member in a range from an upstream end of the nip to a downstream end of the developing zone is not more than 20 mT.

2. An device according to claim 1, wherein the magnetic pole of said magnet member is disposed out of said range.

3. An device according to claim 1, further comprising DC bias applying means for applying a DC bias voltage to said toner carrying member, wherein a toner amount M/S (mg/cm$^2$) on said toner carrying member, a peripheral speed Vp of said electrostatic image bearing member, and a peripheral speed Vs of said toner carrying member, satisfy:

$$1.0 \leqq M/S \times Vs/Vp \leqq 2.5.$$

4. An device according to claim 3, wherein M/S≦1.5 is satisfied.

5. An device according to claim 1, further comprising bias applying means for applying a bias voltage to said toner carrying member to form an alternating electric field in the developing zone, wherein a toner amount M/S (mg/cm$^2$) on said toner carrying member, a peripheral speed Vp of said electrostatic image bearing member, and a peripheral speed Vs of said toner carrying member, satisfy:

$$1.0 \leqq M/S \times Vs/Vp \leqq 2.5.$$

6. An device according to claim 5, wherein M/S≦1.5 is satisfied.

7. An device according to claim 1, wherein the toner is triboelectrically charged by a surface of said regulating member having a triboelectric charge polarity opposed from that of the toner.

8. An device according to claim 1, further comprising electric field forming means for forming an alternating electric field between said toner carrying member and said regulating member.

9. An device according to claim 1, wherein a magnetic pole providing a magnetic flux density not less than 40 mT in a normal line direction on said toner carrying member in a downstream part of the developing zone, is provided downstream of a downstream end of said developing zone.

10. A device according to claim 1, wherein said magnet member does not generate a magnetic field effective for chain erection of the toner in a range from an upstream end of the nip to a downstream end of the developing zone.

* * * * *

UNITED STATES PATENT AND TRADEMARK OFFICE

CERTIFICATE OF CORRECTION

PATENT NO. : 5,781,835

DATED : July 14, 1998

INVENTOR(S) : KEIJI OKANO, ET AL.

COLUMN 2:

Line 2, "example;" should read --example,--;
Line 24, "view" should read --view of--;
Line 39, "show" should read --shows--; and
Line 66, "tile" should read --the--.

COLUMN 3:

Line 37, "is" should read --which is--;
Line 40, "includes" should read --which includes--; and
Line 45, "member:" (second occurrence) should read --member;--.

COLUMN 5:

Line 58, "not" should read --no--.

COLUMN 6:

Line 7, "Te" should read --The--;
Line 8, "device" should read --the device-- and "sheets prints." should read --sheet prints.--;
Line 21, "a mount" should read --amount--; and
Line 57, "rotation" (second occurrence) should be deleted.

UNITED STATES PATENT AND TRADEMARK OFFICE

CERTIFICATE OF CORRECTION

PATENT NO. : 5,781,835

DATED : July 14, 1998

INVENTOR(S) : KEIJI OKANO, ET AL.

COLUMN 7:

Line 4, "not" should read --no; and
Line 66, "of" should be deleted.

COLUMN 8:

Line 11, "extend," should read --extent,--.

COLUMN 10:

Line 48, "6;" should read --6,-- and "111;" shoud read --111,--; and
Line 49, "113;" should read --113,--.

COLUMN 11:

Line 22, "An" should read --A--;
Line 24, "An" should read --A--; and
Line 32, "An" should read --A--.

COLUMN 12:

Line 1, "An" should read --A--;
Line 12, "An" should read --A--;
Line 14, "An" should read --A--;

UNITED STATES PATENT AND TRADEMARK OFFICE

CERTIFICATE OF CORRECTION

PATENT NO. : 5,781,835

DATED : July 14, 1998

INVENTOR(S) : KEIJI OKANO, ET AL.

Line 18, "An" should read --A--; and
Line 22, "An" should read --A--.

Signed and Sealed this

Thirtieth Day of March, 1999

*Attest:*

Q. TODD DICKINSON

*Attesting Officer*

*Acting Commissioner of Patents and Trademarks*